US006822616B2

(12) United States Patent
Durham et al.

(10) Patent No.: US 6,822,616 B2
(45) Date of Patent: Nov. 23, 2004

(54) MULTI-LAYER CAPACITIVE COUPLING IN PHASED ARRAY ANTENNAS

(75) Inventors: Timothy E. Durham, Palm Bay, FL (US); Stephen B. Brown, Palm Bay, FL (US); Anthony A. Jones, Palm Bay, FL (US); Randy Boozer, Melbourne, FL (US); Sean Ortiz, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/308,424

(22) Filed: Dec. 3, 2002

(65) Prior Publication Data

US 2004/0104860 A1 Jun. 3, 2004

(51) Int. Cl.[7] ..... H01Q 9/28
(52) U.S. Cl. ..... 343/795
(58) Field of Search ..... 343/700 MS, 829, 343/846, 753, 909

(56) References Cited

U.S. PATENT DOCUMENTS

| | | | | |
|---|---|---|---|---|
| 3,995,277 A | | 11/1976 | Olyphant, Jr. | |
| 4,081,803 A | * | 3/1978 | Dempsey | 343/795 |
| 5,485,167 A | | 1/1996 | Wong et al. | |
| 6,285,323 B1 | * | 9/2001 | Frank | 343/700 MS |
| 6,351,247 B1 | * | 2/2002 | Linstrom et al. | 343/797 |
| 6,396,449 B1 | * | 5/2002 | Osterhues et al. | 343/754 |
| 6,417,813 B1 | | 7/2002 | Durham | |
| 6,512,487 B1 | * | 1/2003 | Taylor et al. | 343/795 |

FOREIGN PATENT DOCUMENTS

WO WO 02 41443 10/2001

* cited by examiner

*Primary Examiner*—Tho Phan
(74) *Attorney, Agent, or Firm*—Sacco & Associates, PA

(57) ABSTRACT

A phased array antenna (10) includes a current sheet array (20) on a substrate (23), at least one dielectric layer (24) between the current sheet array and a ground plane (30), and at least one conductive plane (25) adjacent to the substrate for providing additional coupling between adjacent dipole antenna elements of the current sheet array.

28 Claims, 11 Drawing Sheets d = dielectric layer
a = adhesive layer
cp = coupling plane
csa = current sheet array or dipole layer
g = ground plane

MULTI-LAYER CAPACITIVE COUPLING IN PHASED ARRAY ANTENNAS

BACKGROUND OF THE INVENTION

1. Statement of the Technical Field

The inventive arrangements relate generally to the field of communications, and more particularly to phased array antennas.

2. Description of the Related Art

Existing microwave antennas include a wide variety of configurations for various applications, such as satellite reception, remote broadcasting, or military communication. The desirable characteristics of low cost, light-weight, low profile and mass producibility are provided in general by printed circuit antennas. The simplest forms of printed circuit antennas are microstrip antennas wherein flat conductive elements are spaced from a single essentially continuous ground element by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, light weight, low profile, and a low sidelobe.

The bandwidth and directivity capabilities of such antennas, however, can be limiting for certain applications. While the use of electromagnetically coupled microstrip patch pairs can increase bandwidth, obtaining this benefit presents significant design challenges, particularly where maintenance of a low profile and broad beam width is desirable. Also, the use of an array of microstrip patches can improve directivity by providing a predetermined scan angle. However, utilizing an array of microstrip patches presents a dilemma. The scan angle can be increased if the array elements are spaced closer together, but closer spacing can increase undesirable coupling between antenna elements thereby degrading performance.

Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwidth of a phased array antenna with a wide scan angle is conventionally achieved by dividing the frequency range into multiple bands.

One example of such an antenna is disclosed in U.S. Pat. No. 5,485,167 to Wong et al. This antenna includes several pairs of dipole pair arrays each tuned to a different frequency band and stacked relative to each other along the transmission/reception direction. The highest frequency array is in front of the next lowest frequency array and so forth.

This approach may result in a considerable increase in the size and weight of the antenna while creating a Radio Frequency (RF) interface problem. Another approach is to use gimbals to mechanically obtain the required scan angle. Yet, here again, this approach may increase the size and weight of the antenna and result in a slower response time.

Thus, there is a need for a lightweight phased array antenna with a wide frequency bandwidth and a wide scan angle, and that is conformally mountable to a surface. Such a need has been met through the use of current sheet arrays or dipole layers using interdigital capacitors that increase coupling by lengthening the capacitor "digits" or "fingers" that result in additional bandwidth as discussed in U.S. Pat. No. 6,417,813 to Durham ('813 Patent) and assigned to the assignee herein. Some antennas of this structure exhibit a significant gain dropout at particular frequencies in the desired operational bandwidth. Thus, a need exists for a lightweight phased array antenna with a wide frequency bandwidth and wide scan angle that is still conformally mountable to a surface and is further not subject to the gain dropout discussed above.

Moreover, there is also a need for feedthrough lens antennas as discussed in the '813 Patent, that also overcomes the gain dropout problem. Feedthrough lens antennas may be used in a variety of applications where it is desired to replicate an electromagnetic (EM) environment present on the outside of a structure within the structure over a particular bandwidth. For example, a feedthrough lens may be used to replicate signals, such as cellular telephone signals, within a building or airplane which may otherwise be reflected thereby. Furthermore, a feedthrough lens antenna may be used to provide a highpass filter response characteristic, which may be particularly advantageous for applications where very wide bandwidth is desirable. An example of such a feedthrough lens antenna is disclosed in the patent to Wong et al. The feedthrough lens structure disclosed in the Wong et al patent includes several of the multiple layered phased array antennas discussed above. Yet, the above noted limitations will correspondingly be present when such antennas are used in feedthrough lens antennas.

SUMMARY OF THE INVENTION

In a first aspect of the present invention, a phased array antenna comprises a substrate and an array of dipole antenna elements thereon where each dipole antenna element comprises a medial feed portion and a pair of legs extending outwardly therefrom. Adjacent legs of adjacent dipole antenna elements preferably include respective spaced apart end portions. The phased array antenna further comprises at least one dielectric layer between the substrate and a ground plane and at least one conductive plane adjacent to the substrate for providing additional coupling between adjacent dipole antenna elements.

In a second aspect of the present invention, a phased array antenna comprises a current sheet array on a substrate, at least one dielectric layer between the current sheet array and a ground plane and at least one conductive plane adjacent to the substrate for providing additional coupling between adjacent dipole antenna elements of the current sheet array.

In a third aspect of the present invention, a method for making a phased array antenna comprises the steps of providing a substrate, forming an array of dipole antenna elements on the substrate to define the phased array antenna, each dipole antenna element comprising a medial feed portion and a pair of legs extending outwardly therefrom, and positioning and shaping respective spaced apart end portions of adjacent legs of adjacent dipole antenna elements to provide increased capacitive coupling between the adjacent dipole antenna elements, and providing a conductive plane adjacent to the array of dipole antenna elements to provide further capacitive coupling between the adjacent dipole antenna elements.

The spaced apart end portions have a predetermined shape and are relatively positioned to provide increased capacitive coupling between the adjacent dipole antenna elements. Preferably, the spaced apart end portions in adjacent legs comprise interdigitated portions, and each leg comprises an elongated body portion, an enlarged width end portion connected to an end of the elongated body portion, and a plurality of fingers, e.g. four, extending outwardly from said enlarged width end portion.

The wideband phased array antenna has a desired frequency range and the spacing between the end portions of adjacent legs is less than about one-half a wavelength of a highest desired frequency. Also, the array of dipole antenna elements may include first and second sets of orthogonal dipole antenna elements to provide dual polarization. A ground plane is preferably provided adjacent the array of dipole antenna elements and is spaced from the array of dipole antenna elements less than about one-half a wavelength of a highest desired frequency.

Preferably, each dipole antenna element comprises a printed conductive layer, and the array of dipole antenna elements are arranged at a density in a range of about 100 to 900 per square foot. The array of dipole antenna elements is sized and relatively positioned so that the wideband phased array antenna is operable over a frequency range of about 2 to 30 Ghz, and at a scan angle of about ±60 degrees. There may be at least one dielectric layer on the array of dipole antenna elements, and the flexible substrate may be supported on a rigid mounting member having a non-planar three-dimensional shape.

Features and advantages in accordance with the present invention are also provided by a method of making a wideband phased array antenna including forming an array of dipole antenna elements on a flexible substrate, where each dipole antenna element comprises a medial feed portion and a pair of legs extending outwardly therefrom. Forming the array of dipole antenna elements includes shaping and positioning respective spaced apart end portions of adjacent legs of adjacent dipole antenna elements to provide increased capacitive coupling between the adjacent dipole antenna elements. Shaping and positioning the respective spaced apart end portions preferably comprises forming interdigitated portions.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
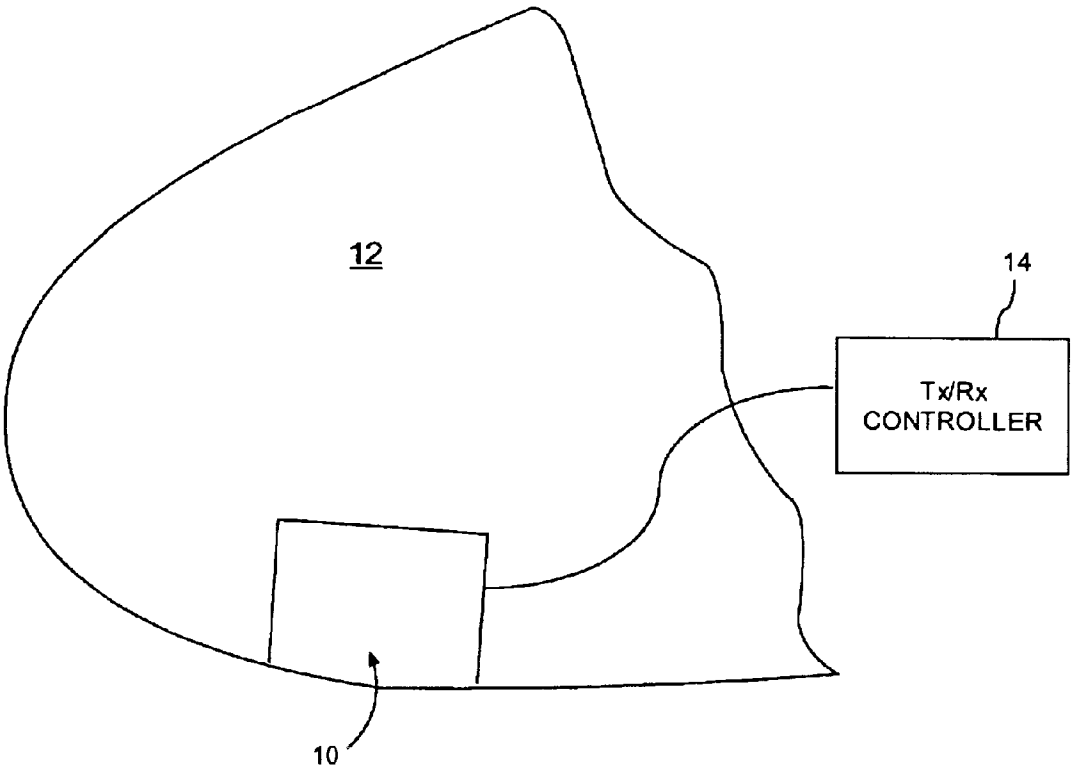
FIG. 1 is a schematic diagram illustrating the wideband phased array antenna of the present invention mounted on the nosecone of an aircraft, for example.

Referring initially to FIGS. 1 and 2(A–C), a wideband phased array antenna 10 in accordance with the present invention is illustrated. The antenna 10 may be mounted on the nosecone 12, or other rigid mounting member having either planar or a non-planar three-dimensional shape, of an aircraft or spacecraft, for example, and may also be connected to a transmission and reception controller 14 as would be appreciated by the skilled artisan.

Figure 2A:
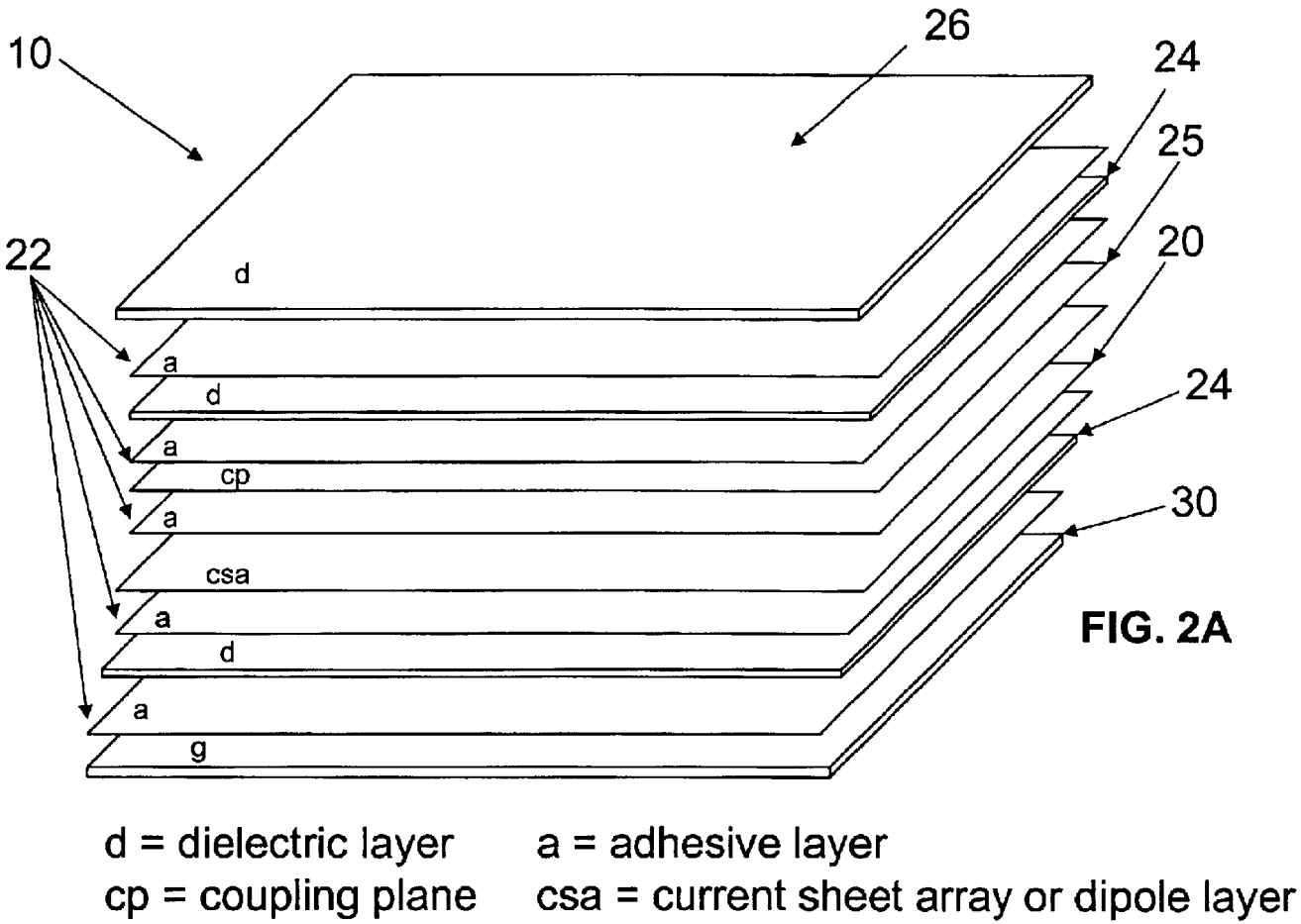
FIGS. 2A, 2B and 2C are exploded views of the wideband phased array antenna of FIG. 1 in various configurations.
Figure 2B:
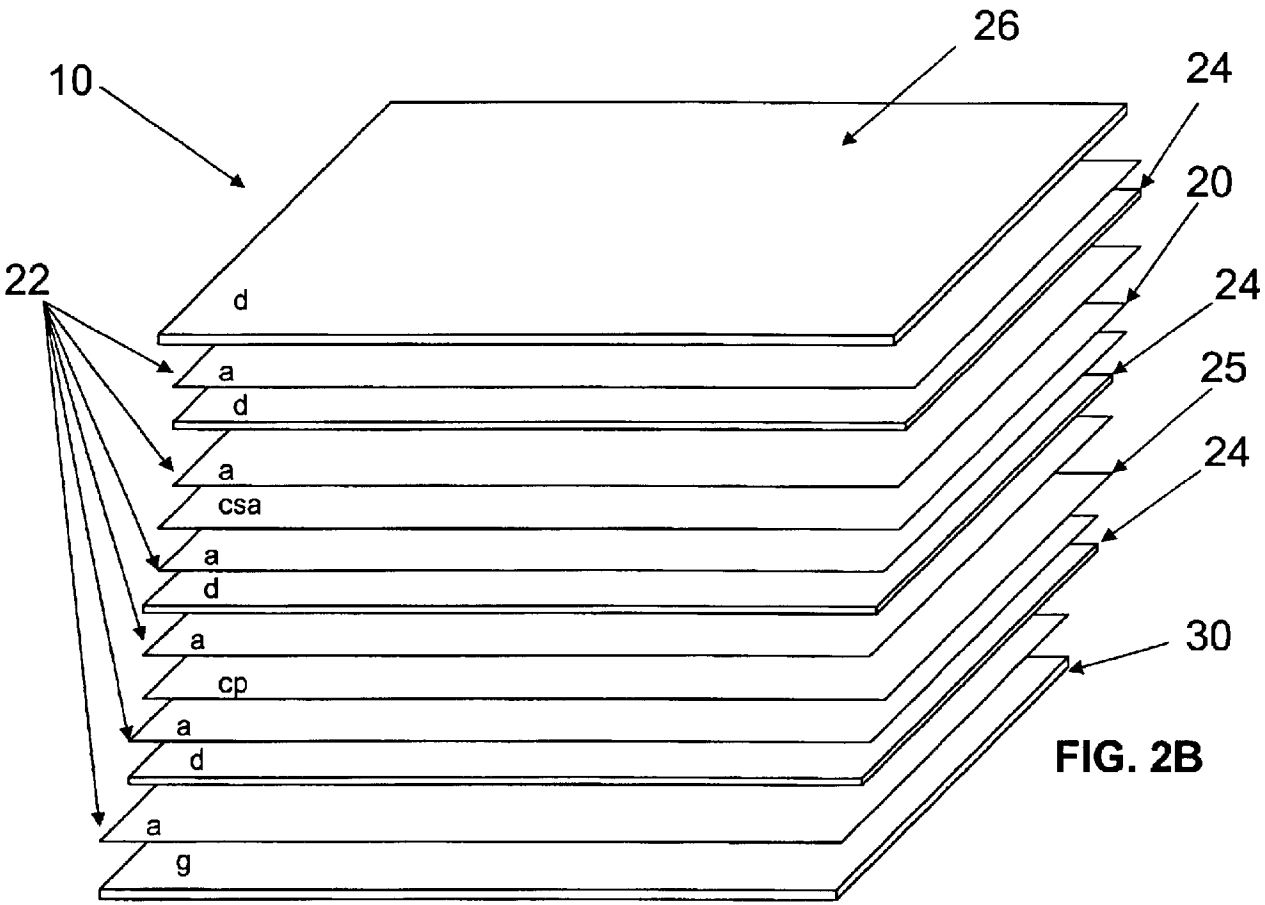
Figure 2C:
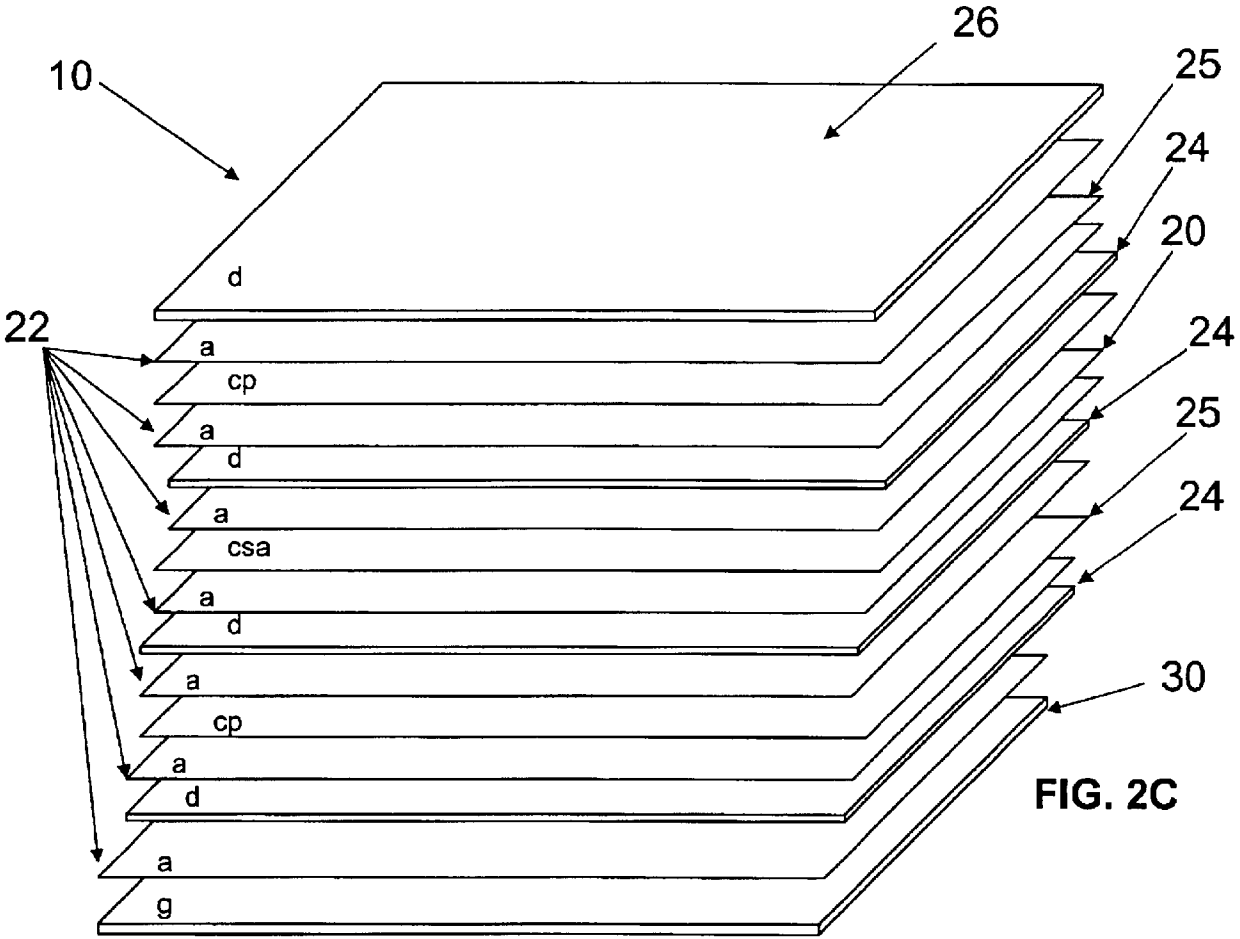

The wideband phased array antenna 10 is preferably formed of a plurality of flexible layers as shown in FIGS. 2A–C. These layers include a dipole layer 20 or current sheet array which is sandwiched between a ground plane 30 and an outer dielectric layer 26 such as the outer dielectric layer of foam shown. Other dielectric layers 24 (preferably made of foam) may be provided in between as shown. Additionally, the phased array antenna 10 further comprises at least one coupling plane 25. It should be noted that the coupling plane can be embodied in many different forms including planes that are only partially metalized or fully metalized, coupling planes that reside above or below the dipole layer 20, or multiple coupling planes that can reside either above or below the dipole layer or both. For example, antenna 10 of FIG. 2A illustrates a coupling plane 25 that resides above the dipole layer 20, whereas FIG. 2B illustrates a coupling plane 25 below the dipole layer 20. Antenna 10 of FIG. 2C illustrates multiple coupling planes (25), one above and one below the dipole layer 20. Each embodiment in FIG. 2 uses respective adhesive layers 22 secure the dipole layer 20, ground plane 30, coupling plane 25, and dielectric layers of foam 24, 26 together to form the flexible and conformal antenna 10. Of course other ways of securing the layers may also be used as would be appreciated by the skilled artisan. The dielectric layers 24, 26 may have tapered dielectric constants to improve the scan angle. For example in FIG. 2A, the dielectric layer 24 between the ground plane 30 and the dipole layer 20 may have a dielectric constant of 3.0, the dielectric layer 24 on the opposite side of the dipole layer 20 may have a dielectric constant of 1.7, and the outer dielectric layer 26 may have a dielectric constant of 1.2.

Figure 3:
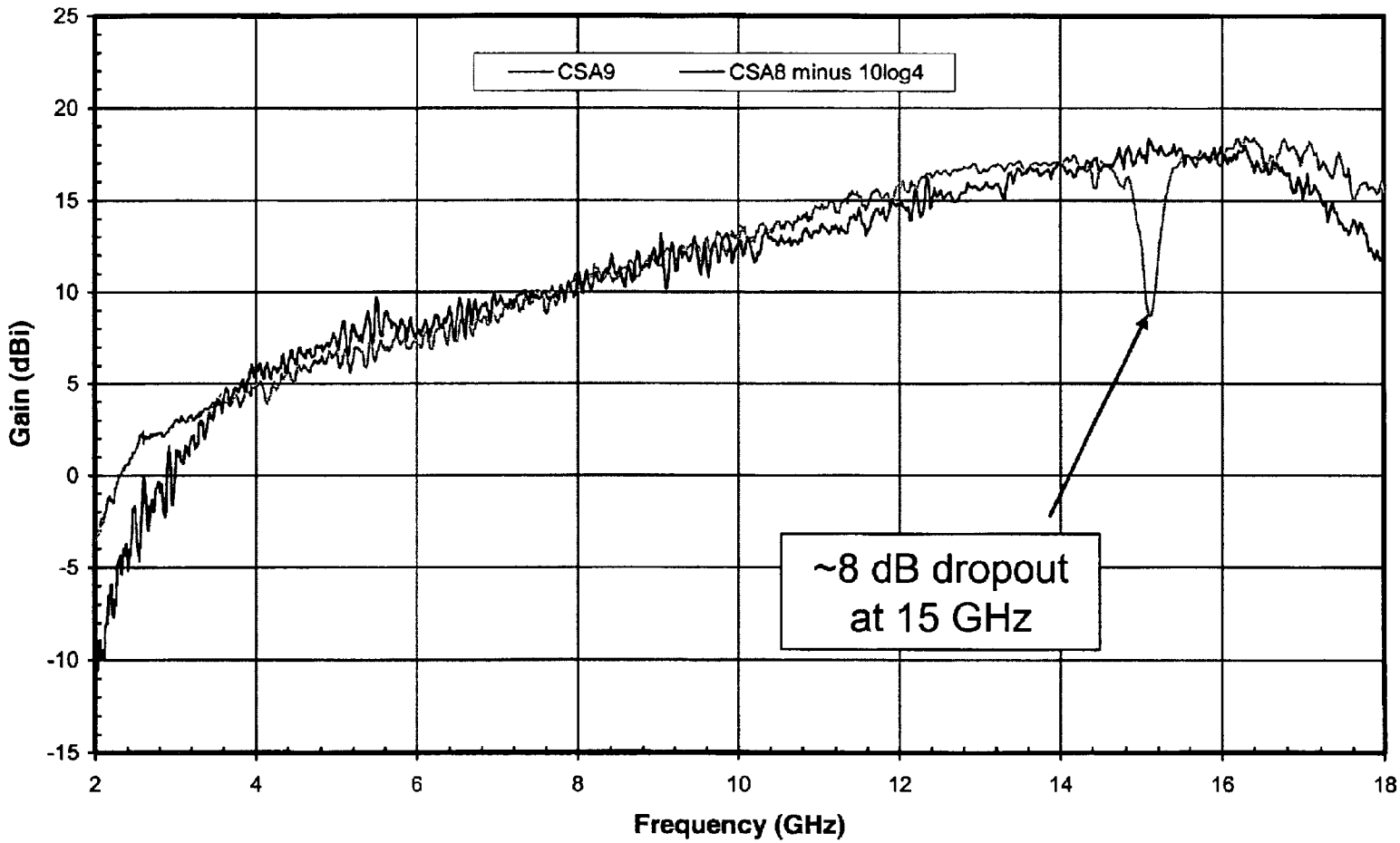
FIG. 3 is a graph illustrating a gain dropout experienced in existing systems having digits of a predetermined length.
Figure 4:
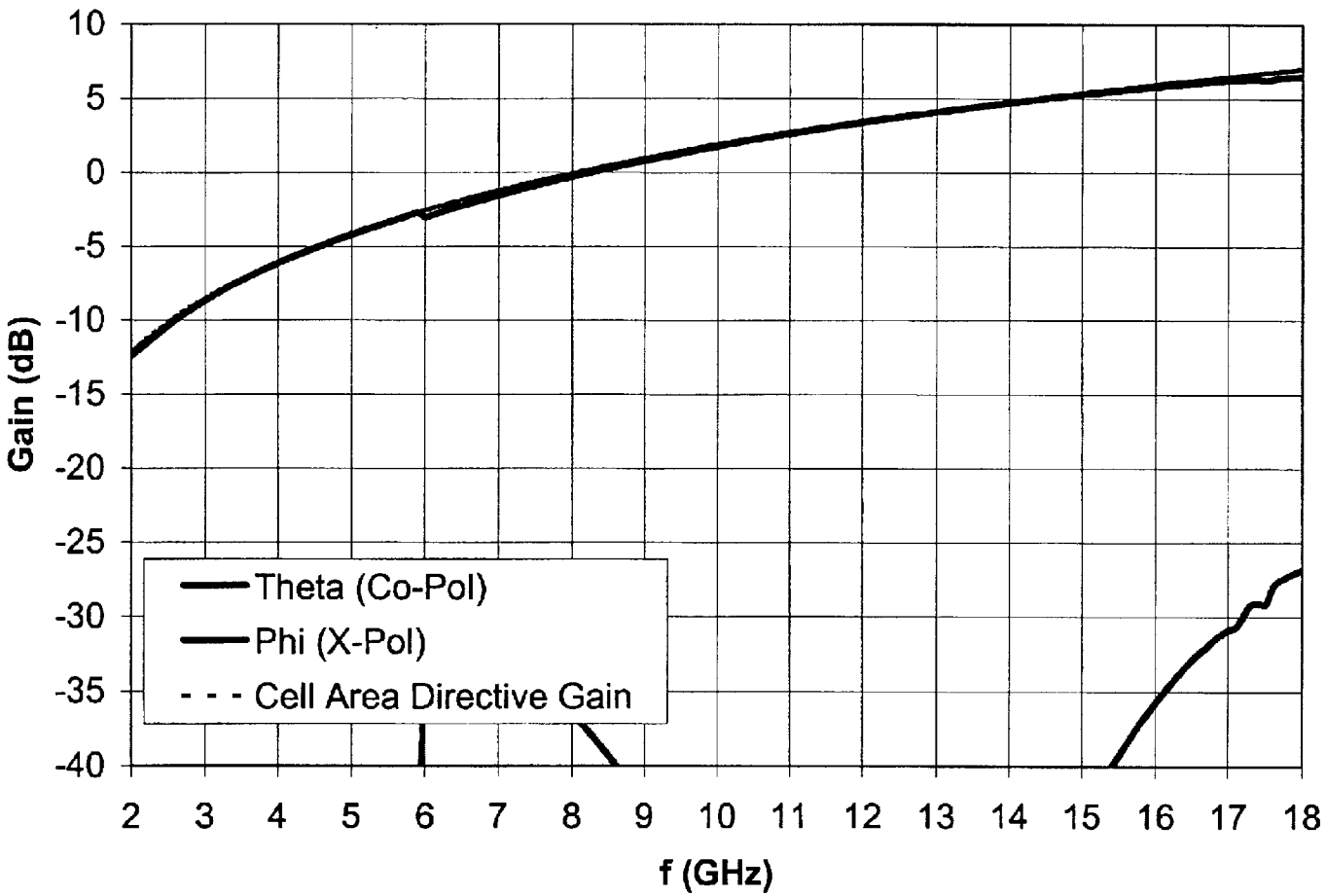
FIGS. 4 and 5 are graphs exhibiting no in-band gain notch for the embodiments of FIGS. 7A and 7B respectively.
Figure 5:
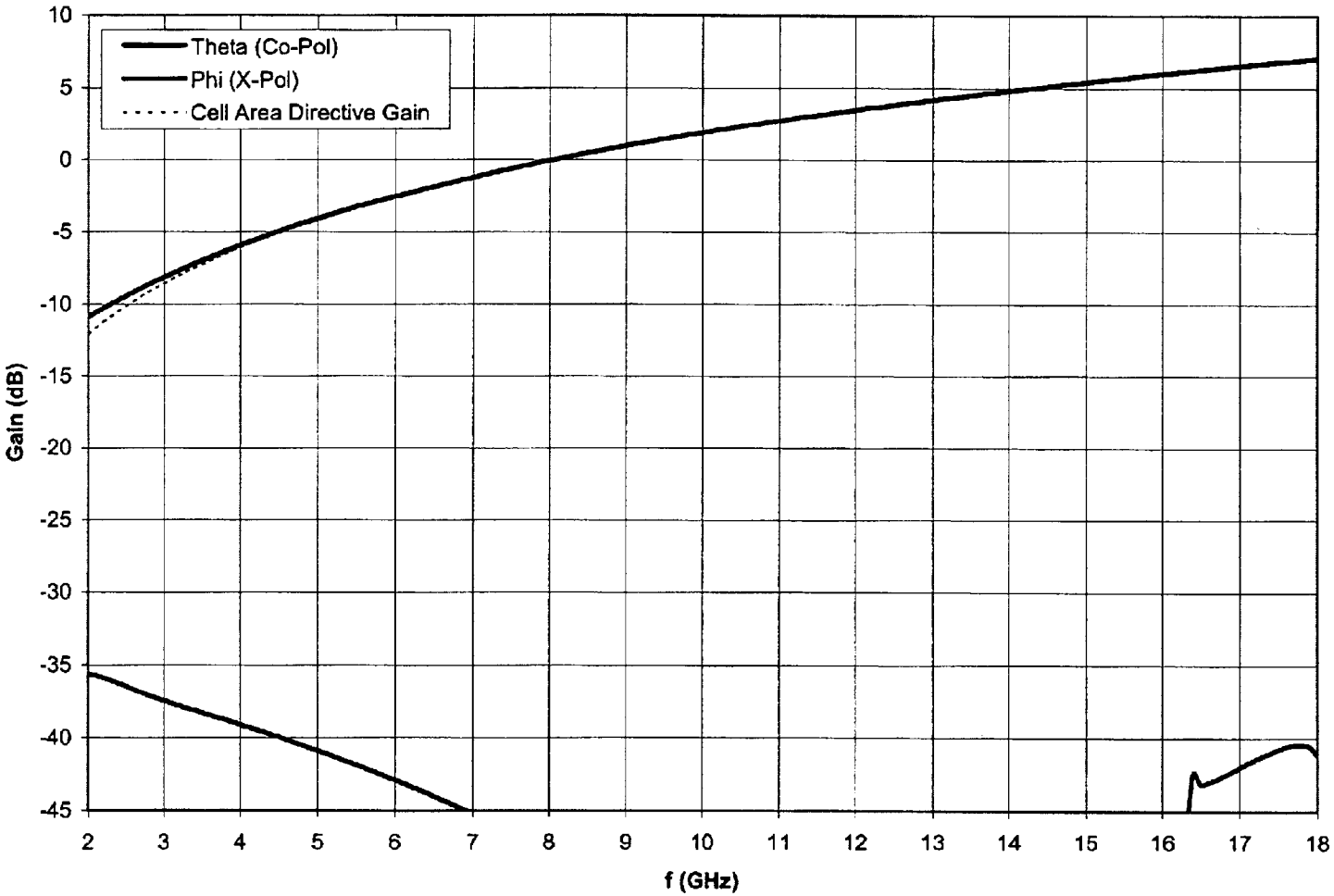
Figure 6:
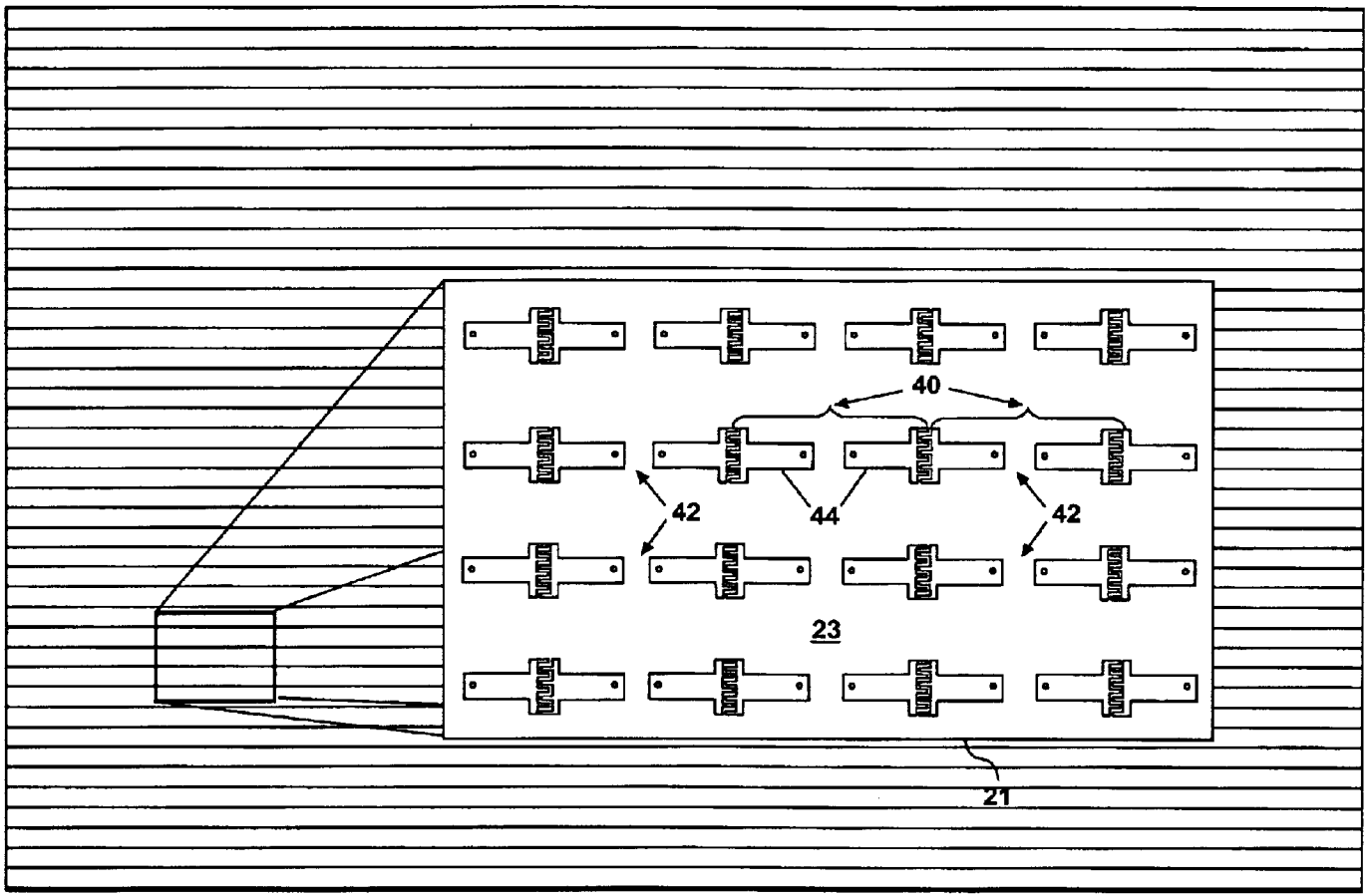
FIG. 6 is a schematic diagram of the printed conductive layer of the wideband phased array antenna of FIG. 1.
Figure 7A:
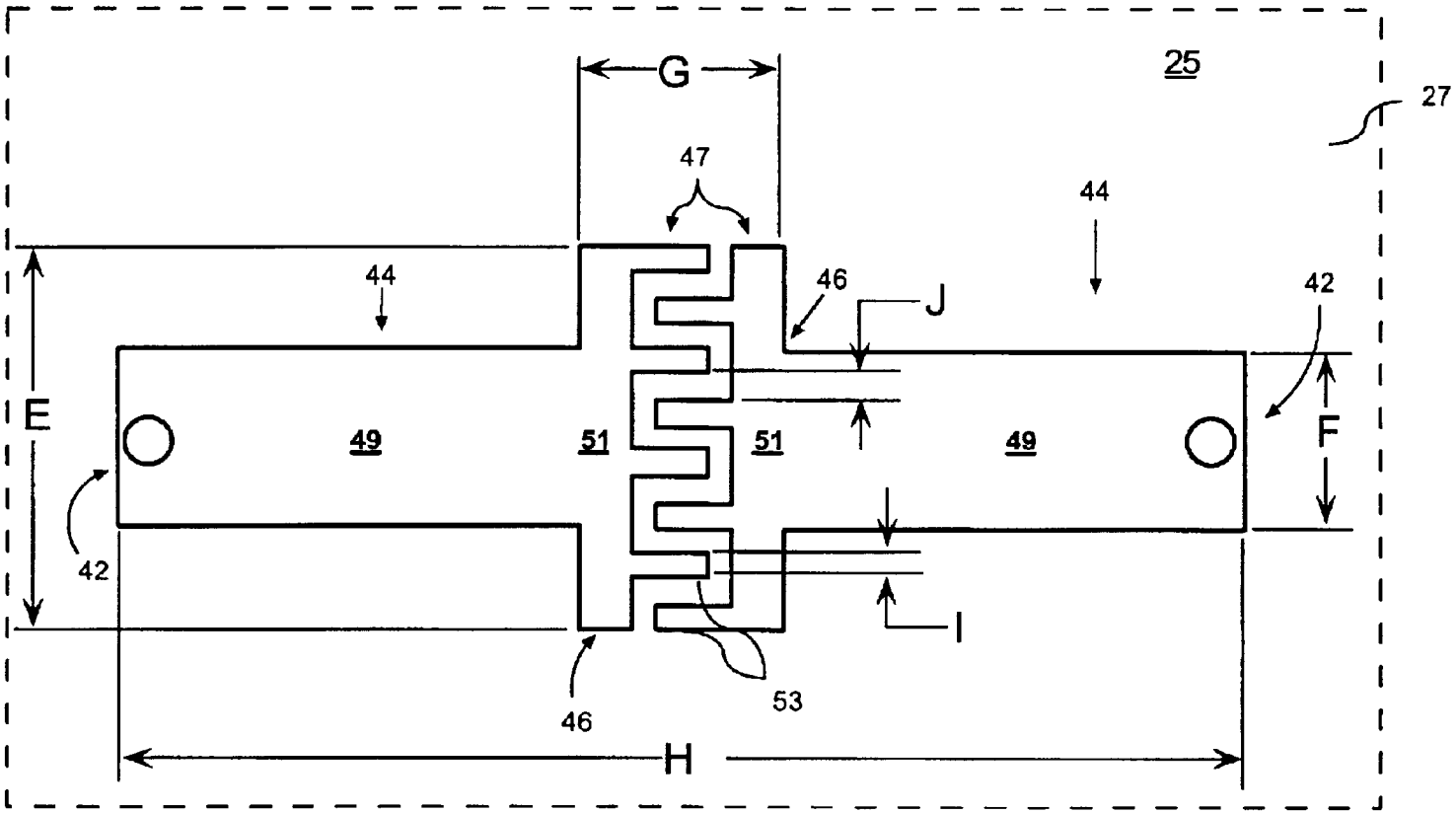
FIGS. 7A and 7B are enlarged schematic views of the spaced apart end portions of adjacent legs of adjacent dipole antenna elements of the wideband phased array antenna of FIG. 2.
Figure 7B:
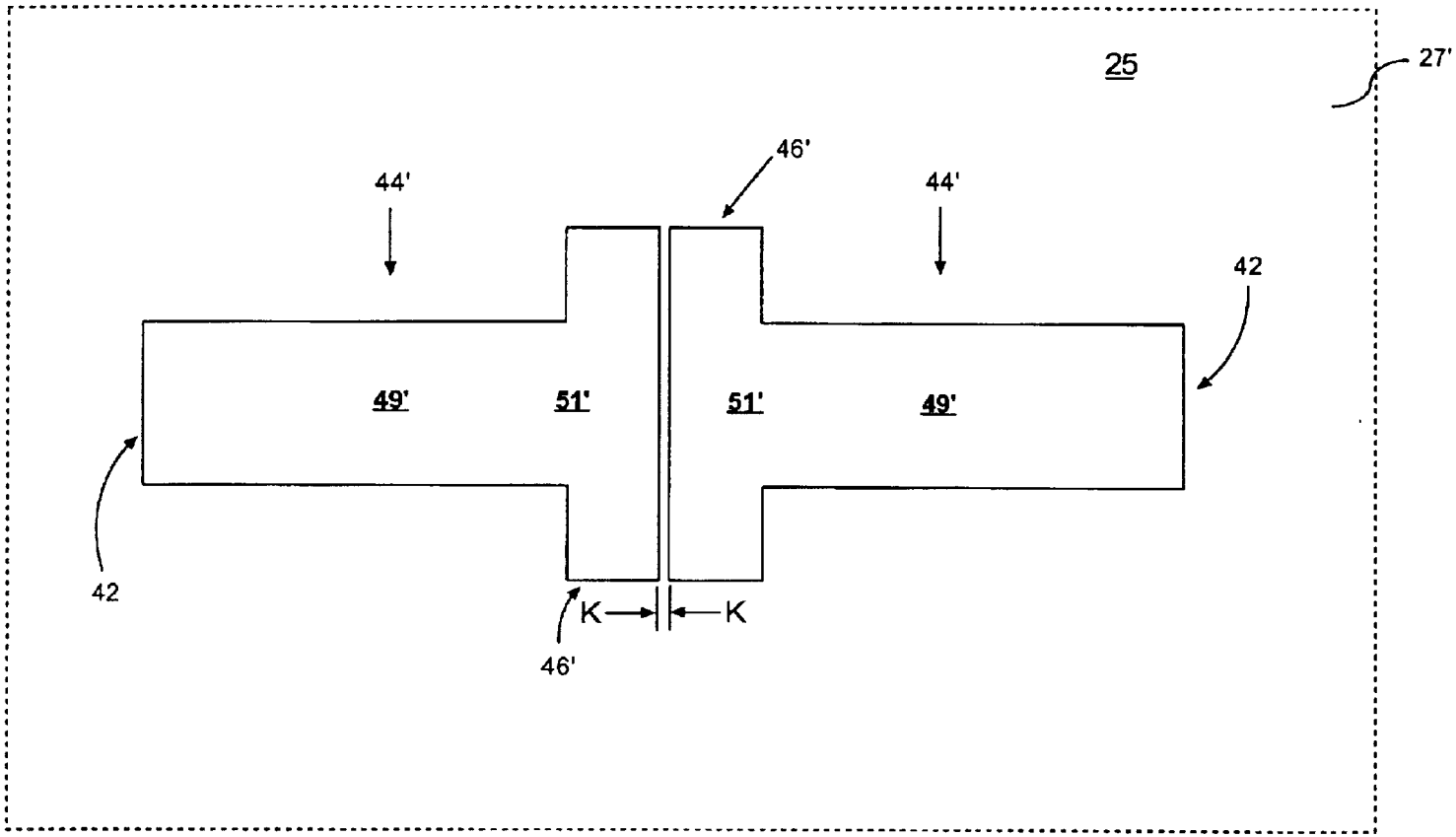

The current sheet array or dipole layer typically consists of closely-coupled dipole elements embedded in dielectric layers above a ground plane. Inter-element coupling can be achieved with interdigital capacitors. Coupling can be increased by lengthening the capacitor digits as shown in FIGS. 6 and 7A. The additional coupling provides more bandwidth. Unfortunately, sufficiently long digits will exhibit a gain dropout, such as a 8 dB gain dropout at 15 GHz as illustrated in the graph of FIG. 3. It is believed that the capacitors tend to act as a bank of quarter-wave ($\lambda/4$) couplers. An E-field plot confirms that cross-polarized capacitors are resonating at a dropout frequency even though only vertically-polarized elements are fed into a particular plot. Despite this, coupling must be maintained to extend the bandwidth of a particular design. The present invention maintains the necessary degree of inter-element coupling by placing coupling plates on separate layers around or adjacent to the interdigital capacitors. Shortening the capacitor digits moves the gain dropout out of band, but reduces coupling and bandwidth. Adding the coupling plates increases the capacitive coupling to maintain or improve bandwidth. The use of coupling plates improves bandwidth in simple designs where no interdigital capacitors are used as shown in FIG. 7B. A projected gain versus frequency plot exhibiting no in-band gain notch is shown in FIG. 4 for an antenna using shorter interdigital capacitors as illustrated in FIG. 7A. Likewise, another projected gain versus frequency plot exhibiting no in-band gain notch is shown in FIG. 5 for an antenna using no interdigital capacitors as illustrated in FIG. 7B.

Referring now to FIGS. 6, 7A and 7B, a first embodiment of the dipole layer 20 will now be described. The dipole layer 20 is a printed conductive layer having an array of dipole antenna elements 40 on a flexible substrate 23. Each dipole antenna element 40 can comprise a medial feed portion 42 and a pair of legs 44 extending outwardly therefrom. Respective feed lines are connected to each feed portion 42 from the opposite side of the substrate 23, as will be described in greater detail below. Adjacent legs 44 of adjacent dipole antenna elements 40 have respective spaced apart end portions 46 to provide increased capacitive coupling between the adjacent dipole antenna elements. The adjacent dipole antenna elements 40 have predetermined shapes and relative positioning to provide the increased capacitive coupling. For example, the capacitance between adjacent dipole antenna elements 40 may be between about 0.016 and 0.636 picofarads (pF), and preferably between 0.159 and 0.239 pF.

Preferably, as shown in FIG. 7A, the spaced apart end portions 46 in adjacent legs 44 have overlapping or interdigitated portions 47, and each leg 44 comprises an elongated body portion 49, an enlarged width end portion 51 connected to an end of the elongated body portion, and a plurality of fingers 53, for example four fingers extending outwardly from the enlarged width end portion.

Alternatively, as shown in FIG. 7B, adjacent legs 44' of adjacent dipole antenna elements 40 may have respective spaced apart end portions 46' to provide increased capacitive coupling between the adjacent dipole antenna elements. In this embodiment, the spaced apart end portions 46' in adjacent legs 44' comprise enlarged width end portions 51' connected to an end of the elongated body portion 49' to provide the increased capacitive coupling between the adjacent dipole antenna elements. Here, for example, the distance K between the spaced apart end portions 46' is about 0.003 inches. As shown in FIGS. 7A and 7B, coupling planes 25 illustrated in dashed lines can reside adjacent to the dipole antenna elements preferably above or below the dipole layer 20. The coupling plane 25 can have metalization 27 on the entire surface of the coupling plane as shown in FIG. 7A or metalization 27' on select portions of the coupling plane as shown in FIG. 7B. Of course, other arrangements which increase the capacitive coupling between the adjacent dipole antenna elements are also contemplated by the present invention.

Preferably, the array of dipole antenna elements 40 are arranged at a density in a range of about 100 to 900 per square foot. The array of dipole antenna elements 40 are sized and relatively positioned so that the wideband phased array antenna 10 is operable over a frequency range of about 2 to 30 GHz, and at a scan angle of about .+−.60 degrees (low scan loss). Such an antenna 10 may also have a 10:1 or greater bandwidth, includes conformal surface mounting, while being relatively lightweight, and easy to manufacture at a low cost.

For example, FIG. 7A is a greatly enlarged view showing adjacent legs 44 of adjacent dipole antenna elements 40 having respective spaced apart end portions 46 to provide the increased capacitive coupling between the adjacent dipole antenna elements. In the example, the adjacent legs 44 and respective spaced apart end portions 46 may have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches. In the example (referring to FIG. 6), the dipole layer 20 may have the following dimensions: a width A of twelve inches and a height B of eighteen inches. In this example, the number C of dipole antenna elements 40 along the width A equals 43, and the number D of dipole antenna elements along the length B equals 65, resulting in an array of 2795 dipole antenna elements.

The wideband phased array antenna 10 has a desired frequency range, e.g. 2 GHz to 18 GHz, and the spacing between the end portions 46 of adjacent legs 44 is less than about one-half a wavelength of a highest desired frequency.

Figure 8:
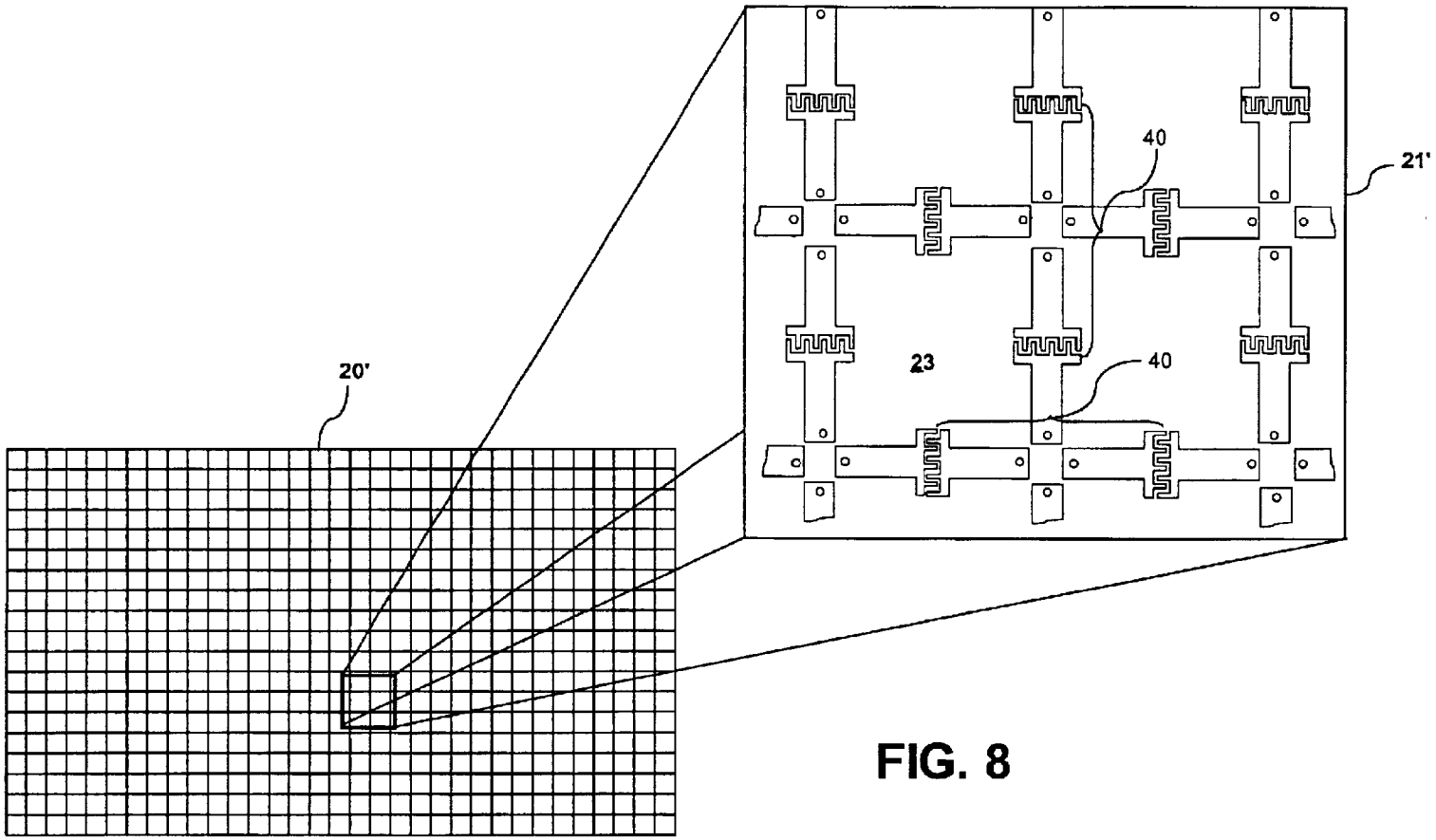
FIG. 8 is a schematic diagram of the printed conductive layer of the wideband phased array antenna of another embodiment of the wideband phased array antenna of FIG. 2.

Referring to FIG. 8, another embodiment of the dipole layer 20' may include first and second sets of dipole antenna elements 40 which are orthogonal to each other to provide dual polarization, as would be appreciated by the skilled artisan The phased array antenna 10 may be made by forming the array of dipole antenna elements 40 on the flexible substrate 23. This preferably includes printing and/or etching a conductive layer of dipole antenna elements 40 on the substrate 23. As shown in FIG. 8, first and second sets of dipole antenna elements 40 may be formed orthogonal to each other to provide dual polarization.

Again, each dipole antenna element 40 includes the medial feed portion 42 and the pair of legs 44 extending outwardly therefrom. Forming the array of dipole antenna elements 40 includes shaping and positioning respective spaced apart end portions 46 of adjacent legs 44 of adjacent dipole antenna elements to provide increased capacitive coupling between the adjacent dipole antenna elements. Shaping and positioning the respective spaced apart end portions 46 preferably includes forming interdigitated portions 47 (FIG. 7A) or enlarged width end portions 51' (FIG. 7B). A ground plane 30 is preferably formed adjacent the array of dipole antenna elements 40, and one or more dielectric layers 24, 26 are layered on both sides of the dipole layer 20 with adhesive layers 22 therebetween.

Again, each dipole antenna element 40 includes the medial feed portion 42 and the pair of legs 44 extending outwardly therefrom. Forming the array of dipole antenna elements 40 includes shaping and positioning respective spaced apart end portions 46 of adjacent legs 44 of adjacent dipole antenna elements to provide increased capacitive coupling between the adjacent dipole antenna elements. Shaping and positioning the respective spaced apart end portions 46 preferably includes forming interdigitated portions 47 (FIG. 7A) or enlarged width end portions 51' (FIG. 7B). A ground plane 30 is preferably formed adjacent the array of dipole antenna elements 40, and one or more dielectric layers 24, 26 are layered on both sides of the dipole layer 20 with adhesive layers 22 therebetween.

As discussed above, the array of dipole antenna elements 40 are preferably sized and relatively positioned so that the wideband phased array antenna 10 is operable over a frequency range of about 2 to 30 GHz, and operable over a scan angle of about .+–.60 degrees. The antenna 10 may also be mounted on a rigid mounting member 12 having a non-planar three-dimensional shape, such as an aircraft, for example.

Thus, a phased array antenna 10 with a wide frequency bandwith and a wide scan angle is obtained by utilizing tightly packed dipole antenna elements 40 with large mutual capacitive coupling. Conventional approaches have sought to reduce mutual coupling between dipoles, but the present invention makes use of, and increases, mutual coupling between the closely spaced dipole antenna elements to prevent grating lobes and achieve the wide bandwidth. The antenna 10 is scannable with a beam former, and each antenna dipole element 40 has a wide beam width. The layout of the elements 40 could be adjusted on the flexible substrate 23 or printed circuit board, or the bean former may be used to adjust the path lengths of the elements to put them in phase.

The present invention can be utilized in a feedthrough lens as described in U.S. Pat. No. 6,417,813 to Timothy Durham, assigned to the assignee herein and hereby incorporated by reference ('813 Patent). As described in the '813 Patent, the feedthrough lens antenna may include first and second phased array antennas (10) that are connected by a coupling structure in back-to-back relation. Again, each of the first and second phased array antennas are substantially similar to the antenna 10 described above. The coupling structure may include a plurality of transmission elements each connecting a corresponding dipole antenna element of the first phased array antenna with a dipole antenna element of the second phased array antenna. The transmission elements may be coaxial cables, for example, as illustratively shown in FIG. 6 of the '813 Patent.

By using the wide bandwidth phased array antenna 10 described above, the feedthrough lens antenna of the present invention will advantageously have a transmission passband with a bandwidth on the same order. Similarly, the feedthrough lens antenna will also have a substantially unlimited reflection band, since the phased array antenna 10 is substantially reflective at frequencies below its operating band. Scan compensation may also be achieved. Additionally, the various layers of the first and second phased array antennas may be flexible as described above, or they may be more rigid for use in applications where strength or stability may be necessary, as will be appreciated by those of skill in the art.

Whether the wideband phased array antenna 10 is used by itself or incorporated in a feedthrough lens antenna, the present invention can preferably be used with applications requiring a continuous bandwidth of 9:1 or greater and certainly extends the operational bandwidth of current sheet arrays or dipole layers as described herein.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A phased array antenna, comprising:

a substrate and an array of dipole antenna elements thereon, each dipole antenna element comprising a medial feed portion and a pair of legs extending outwardly therefrom, adjacent legs of adjacent dipole antenna elements including respective spaced apart end portions;

at least one dielectric layer between the substrate and a ground plane; and at least one conductive plane adjacent to the substrate for providing additional coupling between adjacent dipole antenna elements.

2. The phased array antenna of claim 1, wherein the spaced apart end portions further comprises predetermined shapes positioned relative to each other to provide increased capacitive coupling between adjacent dipole antenna elements.

3. The phased array antenna according to claim 1, wherein the phased array antenna has a desired frequency range and wherein said ground plane is spaced from the array of dipole antenna elements less than about one-half a wavelength of a highest desired frequency.

4. The phased array antenna according to claim 1, wherein each leg comprises an elongated body portion and an enlarged width end portion connected to an end of the elongated body portion.

5. The phased array antenna according to claim 1, wherein the spaced apart end portions in the adjacent legs comprise interdigitated portions.

6. The phased array antenna according to claim 5, wherein each leg comprises an elongated body portion, an enlarged width end portion connected to an end of the elongated body portion, and a plurality of fingers extending outwardly from said enlarged width end portion.

7. The phased array antenna according to claim 1 wherein each phased array antenna has a desired frequency range and wherein the spacing between the end portions of adjacent legs is less than about one-half a wavelength of a highest desired frequency.

8. The phased array antenna according to claim 1, wherein the array of dipole antenna elements comprises first and second sets of orthogonal dipole antenna elements to provide dual polarization.

9. The phased array antenna of claim 1, wherein the phased array antenna forms a part of a feedthrough lens antenna having a coupling structure connecting a first and a second phased array antenna together in back-to-back relation.

10. The phased array antenna according to claim 9, wherein said coupling structure comprises a ground plane.

11. The phased array antenna according to claim 1, wherein the at least one conductive plane resides between the substrate and the ground plane.

12. The phased array antenna according to claim 1, wherein the at least one conductive plane resides between the substrate and a dielectric layer residing above the substrate.

13. A phased array antenna, comprising:

a current sheet array on a substrate;

at least one dielectric layer between the current sheet array and a ground plane; and a plurality or conductive planes adjacent to the substrate, each of the conductive planes respectively providing additional coupling between a single pair of adjacent dipole antenna elements of the current sheet array.

14. The phased array antenna according to claim 13, wherein the phased array antenna has a desired frequency range and wherein said ground plane is spaced from the current sheet array less than about one-half a wavelength of a highest desired frequency.

15. The phased array antenna according to claim 13, wherein the current sheet array comprises the substrate carrying an array of dipole antenna elements.

16. The phased array antenna according to claim 15, wherein the array of dipole antenna elements comprises adjacent legs of adjacent dipole antenna elements including respective spaced apart end portions and wherein each leg comprises an elongated body portion, an enlarged width end portion connected to an end of the elongated body portion, and a plurality of fingers extending outwardly from said enlarged width end portion.

17. The phased array antenna according to claim 16, wherein each phased array antenna has a desired frequency range and wherein the spacing between the end portions of adjacent legs is less than about one-half a wavelength of a highest desired frequency.

18. The phased antenna according to claim 15, wherein each array of dipole antenna elements comprises first and second sets of orthogonal dipole antenna elements to provide dual polarization.

19. The phased array antenna according to claim 13, wherein said at least one conductive plane maintains a wide operational bandwidth while eliminating gain dropout.

20. The phased array antenna of claim 13, wherein the phased array antenna forms a part of a feedthrough lens antenna having a coupling structure connecting a first and a second phased array antenna together in back-to-back relation.

21. A method for making a phased array antenna comprising:

providing a substrate; forming an array of dipole antenna elements on the substrate to define the phased array antenna, each dipole antenna element comprising a medial feed portion and a pair of legs extending outwardly therefrom, and positioning and shaping respective spaced apart end portions of adjacent legs of adjacent dipole antenna elements to provide increased capacitive coupling between the adjacent dipole antenna elements;

providing a conductive plane adjacent to the array of dipole antenna elements to provide further capacitive coupling between the adjacent dipole antenna elements.

22. The method according to claim 21, wherein the phased array antenna has a desired frequency range and wherein the ground plane is spaced from the array of dipole antenna elements less than about one-half of a wavelength of a highest desired frequency.

23. The method according to claim 21, further comprising forming at least one dielectric layer on the array of dipole antenna elements.

24. The method according to claim 21, wherein forming the array of dipole elements comprises forming each leg with an elongated body portion, and an enlarged width end portion connected to an end of the elongated body portion.

25. The method according to claim 21, wherein shaping and positioning respective spaced apart end portions comprises forming interdigitated portions.

26. The method according to claim 25, wherein forming the array of dipole antenna elements comprises forming each leg with an elongated body portion, an enlarged width end portion connected to an end of the elongated body portion, and a plurality of fingers extending outwardly from the enlarged width end portion.

27. The method according to claim 21, wherein each phased array antenna has a desired frequency range and wherein the spacing between the end portions of adjacent legs is less than about one-half of a wavelength of a highest desired frequency.

28. The method according to claim 21, wherein forming each array of dipole antenna elements comprises forming first and second sets of orthogonal dipole antenna elements to provide dual polarization.

* * * * *

UNITED STATES PATENT AND TRADEMARK OFFICE

CERTIFICATE OF CORRECTION

PATENT NO. : 6,822,616 B2
DATED : November 23, 2004
INVENTOR(S) : Durham, Timothy E. et al.

It is certified that error appears in the above-identified patent and that said Letters Patent is hereby corrected as shown below:

Title page,
Item [75], Inventors, "Anthony A. Jones" and replace with -- Anthony M. Jones --

Column 8,
Line 54, delete "or" and replace with -- of --

Signed and Sealed this

Nineteenth Day of July, 2005

JON W. DUDAS
*Director of the United States Patent and Trademark Office*